US007004252B2

(12) United States Patent
Vise, Jr.

(10) Patent No.: US 7,004,252 B2
(45) Date of Patent: Feb. 28, 2006

(54) MULTIPLE ZONE TESTING SYSTEM

(75) Inventor: Charles E. Vise, Jr., St. Bernard, LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 171 days.

(21) Appl. No.: 10/684,604

(22) Filed: Oct. 14, 2003

(65) Prior Publication Data

US 2005/0077086 A1 Apr. 14, 2005

(51) Int. Cl.
*E21B 47/01* (2006.01)

(52) U.S. Cl. ..... 166/250.01; 166/264; 175/59; 175/40

(58) Field of Classification Search ..... 166/250.01, 166/250.17, 264, 373, 191, 162, 316; 175/40, 175/58, 59, 230; 73/152.18, 152.23, 152.28, 73/152.38

See application file for complete search history.

(56) References Cited

U.S. PATENT DOCUMENTS

| | | | | |
|---|---|---|---|---|
| 2,564,198 | A * | 8/1951 | Elkins | 73/152.18 |
| 2,609,878 | A * | 9/1952 | Halliburton | 166/107 |
| 4,796,699 | A | 1/1989 | Upchurch | |
| 4,896,722 | A | 1/1990 | Upchurch | |
| 4,915,168 | A | 4/1990 | Upchurch | |
| 5,691,712 | A | 11/1997 | Meek et al. | |
| 5,810,087 | A | 9/1998 | Patel | |
| 5,950,733 | A | 9/1999 | Patel | |
| 6,041,864 | A | 3/2000 | Patel et al. | |
| 6,085,845 | A | 7/2000 | Patel et al. | |
| 6,173,772 | B1 | 1/2001 | Vaynshteyn | |
| 6,227,298 | B1 * | 5/2001 | Patel | 166/321 |
| 6,230,807 | B1 | 5/2001 | Patel | |
| 6,250,383 | B1 | 6/2001 | Patel | |
| 6,302,216 | B1 * | 10/2001 | Patel | 166/375 |
| 6,325,146 | B1 * | 12/2001 | Ringgenberg et al. | 166/250.17 |
| 6,328,109 | B1 | 12/2001 | Pringle et al. | |
| 6,352,119 | B1 | 3/2002 | Patel | |
| 6,357,525 | B1 * | 3/2002 | Langseth et al. | 166/264 |
| 6,401,826 | B1 | 6/2002 | Patel | |
| 6,516,886 | B1 | 2/2003 | Patel | |
| 6,550,541 | B1 | 4/2003 | Patel | |
| 6,634,429 | B1 * | 10/2003 | Henderson et al. | 166/332.1 |
| 6,745,834 | B1 * | 6/2004 | Davis et al. | 166/250.17 |
| 2002/0100585 | A1 * | 8/2002 | Spiers et al. | 166/264 |
| 2003/0150622 | A1 * | 8/2003 | Patel et al. | 166/373 |
| 2003/0192689 | A1 * | 10/2003 | Moake et al. | 166/250.01 |
| 2004/0251022 | A1 * | 12/2004 | Smith | 166/250.17 |

OTHER PUBLICATIONS

"Formation Isolation Valve", Schlumberger catalog—QUANTUM Sand Control Accessories, p. 43.
"IRIS Operated Dual Valve (IRDV)". Schlumberger catalogue data sheet, Apr. 2002.

* cited by examiner

*Primary Examiner*—David Bagnell
*Assistant Examiner*—Daniel P Stephenson
(74) *Attorney, Agent, or Firm*—Winstead Sechrest & Minick P.C.; Bryan P. Galloway; Jaime A. Castano

(57) ABSTRACT

A method and system for drillstem testing multiple zones in a well with a single testing trip into the well. A multiple zone tester is landed in the lower completion to form separate controllable flow paths from each of the zones. The multiple zone testing system facilitates testing each zone singularly and performing commingled tests without pulling out of the well.

19 Claims, 4 Drawing Sheets

MULTIPLE ZONE TESTING SYSTEM

FIELD OF THE INVENTION

The present invention relates in general to testing of zones before completion of a well and more particularly to a drillstem testing system that facilitates testing of multiple zones singularly in a single trip into the well.

BACKGROUND

Often in a wellbore more than one formation or zone is intersected for production and/or injection of a fluid. Typically, in multiple zone wells a lower zone is completed first. This completion may include gravel pack, stand alone screen, expandable screen casing and perforation, or a combination of apparatus and methods. At this stage of the drilling operation it is often desired to test the zone utilizing drillstem testing (DST) to determine certain characteristics of the selected zone and the viability for production and/or injection. Drillstem testing at this stage provides information that can be utilized for decisions regarding further completion of the well.

After completion of the lower zone, the lower zone may be "killed" or isolated utilizing formation isolation valves so that the upper zone can be completed. Once the upper zone is completed it is often desired to test the upper zone for same reasons as testing of the lower zone. This completion and testing process is performed through several trips in the wellbore in addition to those performed regarding the completion and testing of the first or lower zone.

Drillstem testing is utilized to determine data related to, but not limited to, the productive capacity, pressure, and permeability of the selected formation. These tests are usually conducted with a downhole shut-in tool that allows the well to be opened and closed at the bottom of the wellbore. One or more pressure gauges are customarily mounted in the DST tool and are read and interpreted after the test is completed. It is also often desirable to obtain a sample of the fluid produced from a zone without producing the fluid to the surface, the sample being collected downhole. The data obtained from these drillstem tests facilitate educated decisions regarding further completion of the well.

Although drillstem testing of formations may reduce the total cost of drilling and completing a well, the drill stem testing process is also costly and time consuming. The current process of testing multiple zones in a well includes (well utilizing perforation and gravel packing): 1) trip into hole to perforate first zone; 2) trip into hole to gravel pack/complete lower zone; 3) trip into hole and drillstem test the lower zone, kill the well after the test; 4) trip into hole to perforate upper zone; 5) trip into hole to gravel pack/complete upper zone; 6) trip into hole and drillstem test the upper zone, kill the well after the test; 7) trip into the hole with the drillstem tester to configure the hole and test commingled production from the lower and upper zones. Various methods may be utilized to complete the production zones, however, the prior art system typically requires three (3) trips in the wellbore to perform two independent zone tests and a commingled test. This prior art method, while effective, is time consuming and costly.

It is a desire to provide a multiple zone testing system that permits a single trip into the hole to test multiple zones. It is a further desire to provide multiple zone testing system that facilitates separate testing of individual zones and commingled flow testing of multiple zones.

SUMMARY OF THE INVENTION

In view of the foregoing and other considerations, the present invention relates to drillstem testing.

It is a benefit of the present invention to provide a multiple zone testing system that facilitates singular testing of multiple zones in a well without having to pull out of the well between tests.

It is a further benefit of the present invention to provide a multiple zone testing system that facilitates singular testing of multiple zones in a well without having to kill a zone between tests.

Accordingly, a multiple zone testing system is provided that facilitates testing multiple zones of a well singularly with a single trip into the well. The multiple zone testing system comprises a multiple valve mechanism having an upper valve for controlling fluid flow from an upper zone via a flow conduit, and a lower valve for controlling fluid flow from a lower zone via a bore, a control conduit formed between a well annulus and the multiple valve mechanism to communicate a signal to selectively actuate the upper and lower valves, a seal assembly adapted for temporary sealing engagement with a lower completion, an upper zone measurement gauge functionally connected to the flow conduit, and a lower zone measurement gauge functionally connected to the bore.

A method of drillstem testing multiple zones in a well comprises the steps of completing a lower zone and completing an upper zone to form a lower completion, running a multiple zone tester into the well on a pipe string to the lower completion, sealing the multiple zone tester in the lower completion in a manner such that fluid flow from the lower zone is controlled by a lower valve through a bore, and fluid flow from the upper zone is controlled by an upper valve through a flow conduit, actuating the lower valve in communication with the bore to an open position, and actuating the upper valve in communication with the flow conduit to a closed position to test the lower zone, measuring characteristics of the lower zone, actuating the lower valve in communication with the bore to a closed position, and actuating the upper valve in communication with the flow conduit to an open position to test the upper zone, measuring characteristics of the upper zone, circulating fluid out of the drillstring, removing the multiple zone tester from the lower completion closing the top most formation isolation valve, and retrieving the measured zone characteristics obtained.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
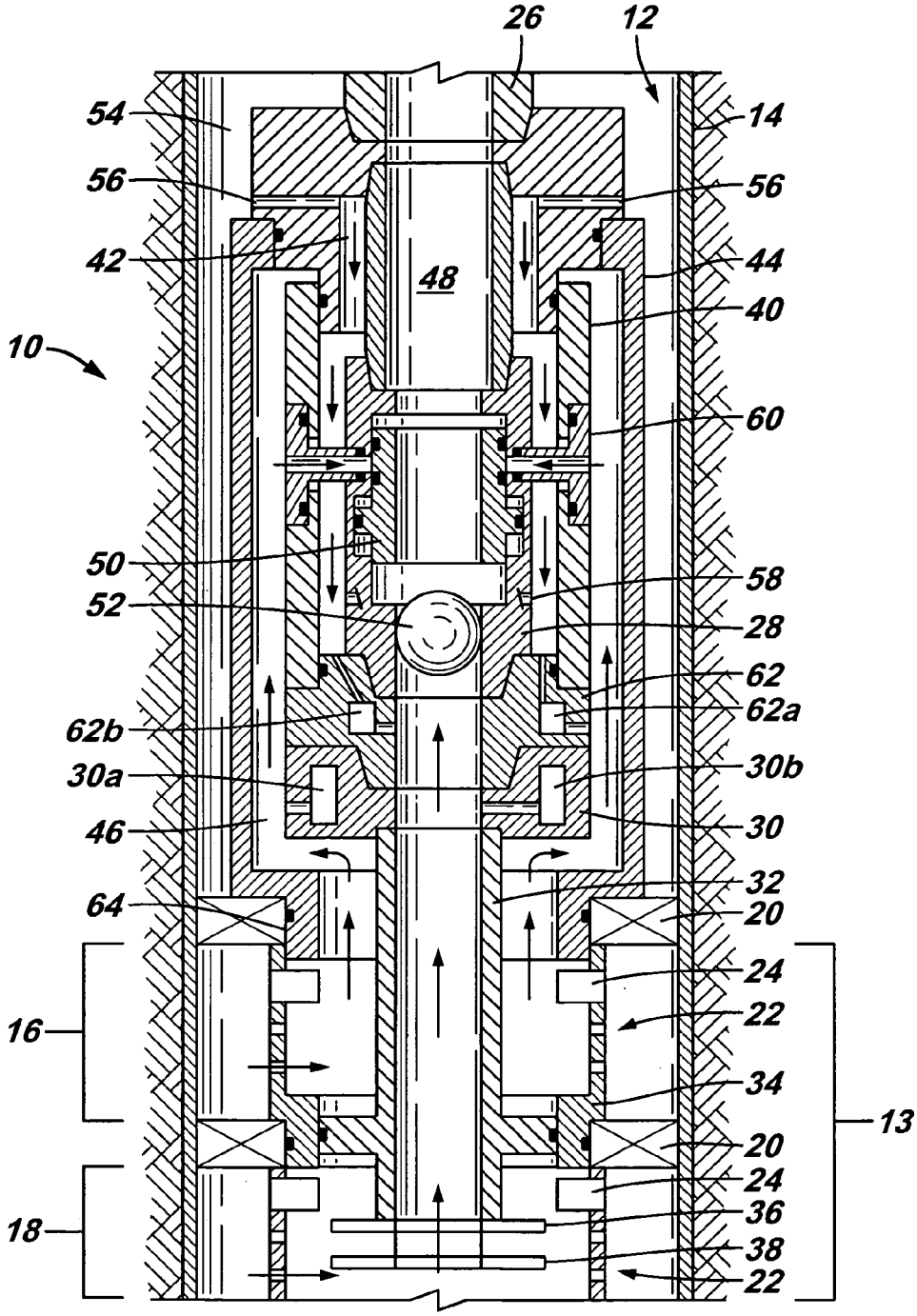
FIG. 1 is a schematic drawing of the multiple zone testing system of the present invention of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic representation of the multiple zone testing system of the present invention generally designated by the numeral 10. A wellbore 12 is drilled down to a depth intersecting an upper fluid producing zone 16 and a lower fluid producing zone 18. In the embodiments shown wellbore 12 includes casing 14.

Each of the zones 16 and 18 are completed for production generally denoted as lower completion 13. For exemplary purposed the producing zones are shown as completed with a gravel pack installation, including gravel pack packers 20, screens 22, and formation isolation valves (FIV) 24. The formation isolation valves 24 are positioned proximate each of the producing zones for closing to isolate below the formation isolation valve 24 from above the formation isolation valve 24. The producing zone completions may be gravel pack, stand alone screen, expandable screen, cased and perforated or a combination of the above methods.

Upon completion of each of the producing zones 16 and 18, the present multiple zone testing system 10 allows for testing of zones 16 and 18 singularly and in combination in a single drillstem testing trip into wellbore 12 without having to complete the well above the producing zone completions. The present invention can significantly reduce the time consumed testing of the prior art drillstem testing systems. Additionally, the present system reduces the opportunities to damage the formation and equipment failures in the wellbore.

FIG. 1 demonstrates a multiple zone testing system 10 positioned above, or without, a drillstem packer. Multiple zone tester 10 is run into wellbore 12 on a drillstem string 26 and stabbed into the completion of production zones 16 and 18. Multiple zone tester 10 includes a multivalve mechanism 28, a gauge carrier 30, a dip tube 32 with a seal assembly 34, an open/close shifting tool 36, an open only shifting tool 38, an inner shroud 40 forming a control conduit 42, and an outer shroud 44 forming a flow conduit 46. An internal bore 48 if formed through drillstem string 26 and multiple zone tester 10.

Multivalve mechanism 28 includes an upper valve 50 and a lower valve 52. Upper valve 50 controls flow from upper zone 16 from the exterior of bore 48 into bore 48. Lower valve 52 controls flow from lower zone 18 through bore 48. For descriptive purposes multivalve mechanism 28 is an intelligent remote implementation system (IRIS) dual valve by Schlumberger. Upper valve 50 is a sliding sleeve and lower valve 52 is a ball valve. Alternatively, the lower valve may be a shrouded sliding sleeve with a plug on the bottom. Multivalve mechanism 28 is controlled via hydraulics and electronics to open and close valves 50 and 52. Multivalve mechanism 28 may be controlled by telemetry. As shown in FIG. 1, multivalve 28 is controlled via pressure pulse signals passed through fluid in wellbore annulus 54 through a port 56 through conduit 42 formed by the inner shroud 40 and multivalve assembly 28 to multivalve 28 through a port 58. Flow shroud 44 separates the fluid produced from upper zone 16 from the fluid in annulus 54.

Conduit 46 is formed between outer flow shroud 44 and flow shroud 40 carried by multivalve mechanism 28 and is in fluid communication between upper zone 16 and bore 48. Flow of fluid from upper zone 16 into bore 48 is controlled through a circulating port 60 by upper valve 50.

Gauge carrier 30 is run below multivalve mechanism 28 and carries at least two pressure gauges 30*a* and 30*b*. Gauge 30*a* is ported to conduit 46 so as to be in functional contact with upper zone 16. Gauge 30*b* is ported to bore 48 so as to be in functional contact with lower zone 18.

It may also be desired for multiple zone tester 10 to include a sample chamber 62 for capturing fluid from zones 16 and 18. Sample chamber 62 carries at least two individual sample chambers 62*a* and 62*b*. Chamber 62*a* being ported external of bore 48 to capture fluid from upper zone 16. Chamber 62*b* being ported into bore 48 to capture fluid from lower zone 18.

Dip tube 32 extends from multivalve mechanism 28 a distance sufficient to reach lower zone 18. Carried on the bottom of dip tube 32 is an open/close shifting tool 36 and an open only shifting tool 38. Shifting tools 36 and 38 are adapted to operate formation isolation valves 24. Dip tube 32 forms a portion of bore 48 for flowing lower zone 18.

Seal assembly 34 is a lower zone multiple seal assembly (LZMSA) carried by dip tube 32 and positioned in polished bore receptacles 64. When multiple zone tester 10 is positioned for testing, seal assembly 34 forms a seal between packer 20 positioned between upper zone 16 and lower zone 18 isolating the respective zones from each other. In the testing position a fluid path is formed from upper zone 16 outside of dip tube 32 and bore 48 through conduit 46 to circulating port 60. A fluid flow path is formed from lower zone 18 through bore 48.

Figure 2:
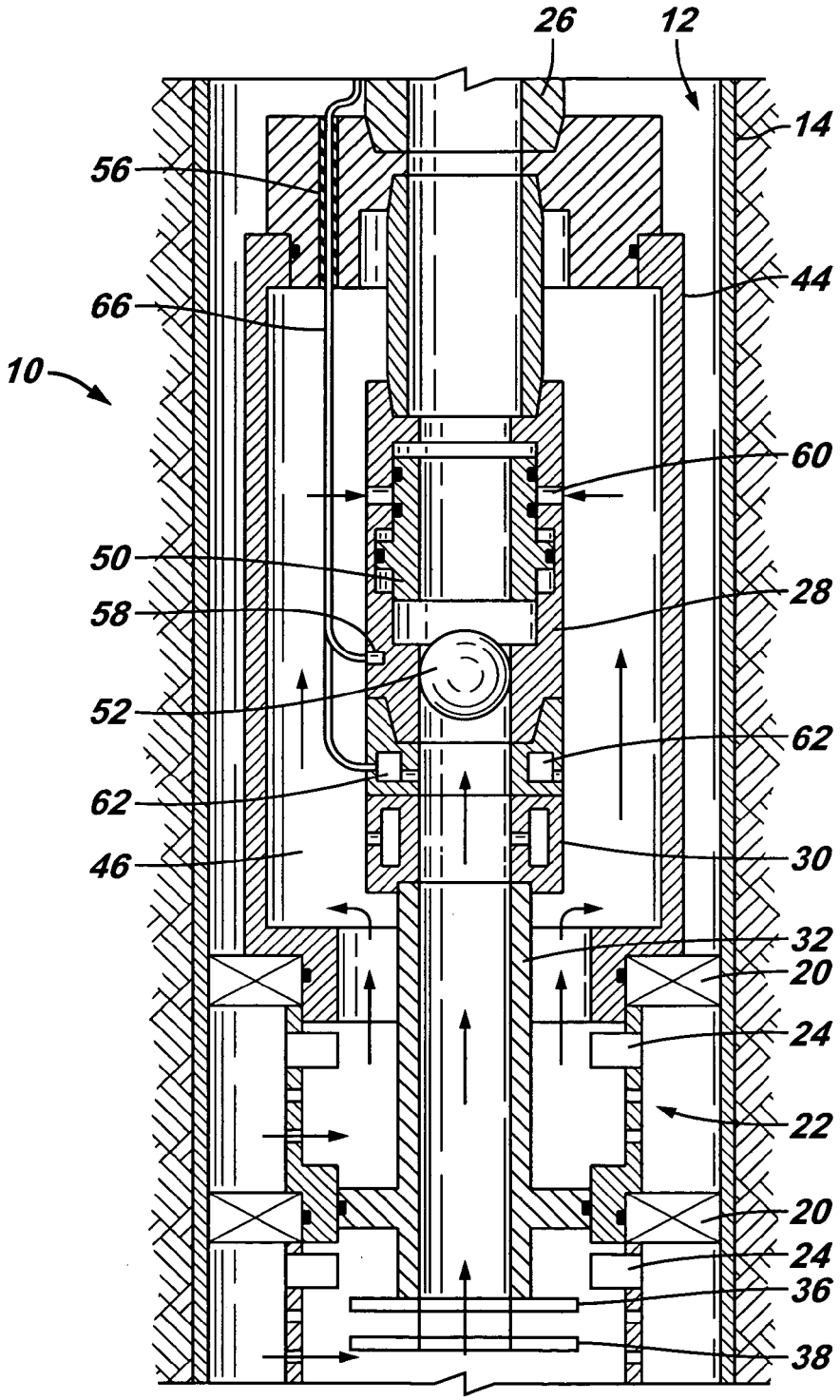
FIG. 2 is a schematic drawing of another embodiment of the multiple zone testing system of the present invention.

FIG. 2 is a schematic representation of another embodiment of multiple zone testing system 10 of the present invention. In this embodiment multivalve mechanism 28 is controlled via a control conduit 66. Control conduit 66 may be a hydraulic line connected between the surface (not shown) and multivalve 28. Hydraulic control line 66 connects the fluid in annulus 54 to multivalve 28 for transmitting the pressure pulse and operating multivalve 28. It may be desired for control conduit 66 to be an electric line for transmitting electronic signals from the surface to actuate multivalve 28, and or to actuate sample chambers 62, and for real time read out of pressure gauges 30*a* and 30*b*. As can be seen utilization of control conduit 66 replaces the inner shroud 40 and control conduit 42 as shown in FIG. 1.

Figure 3:
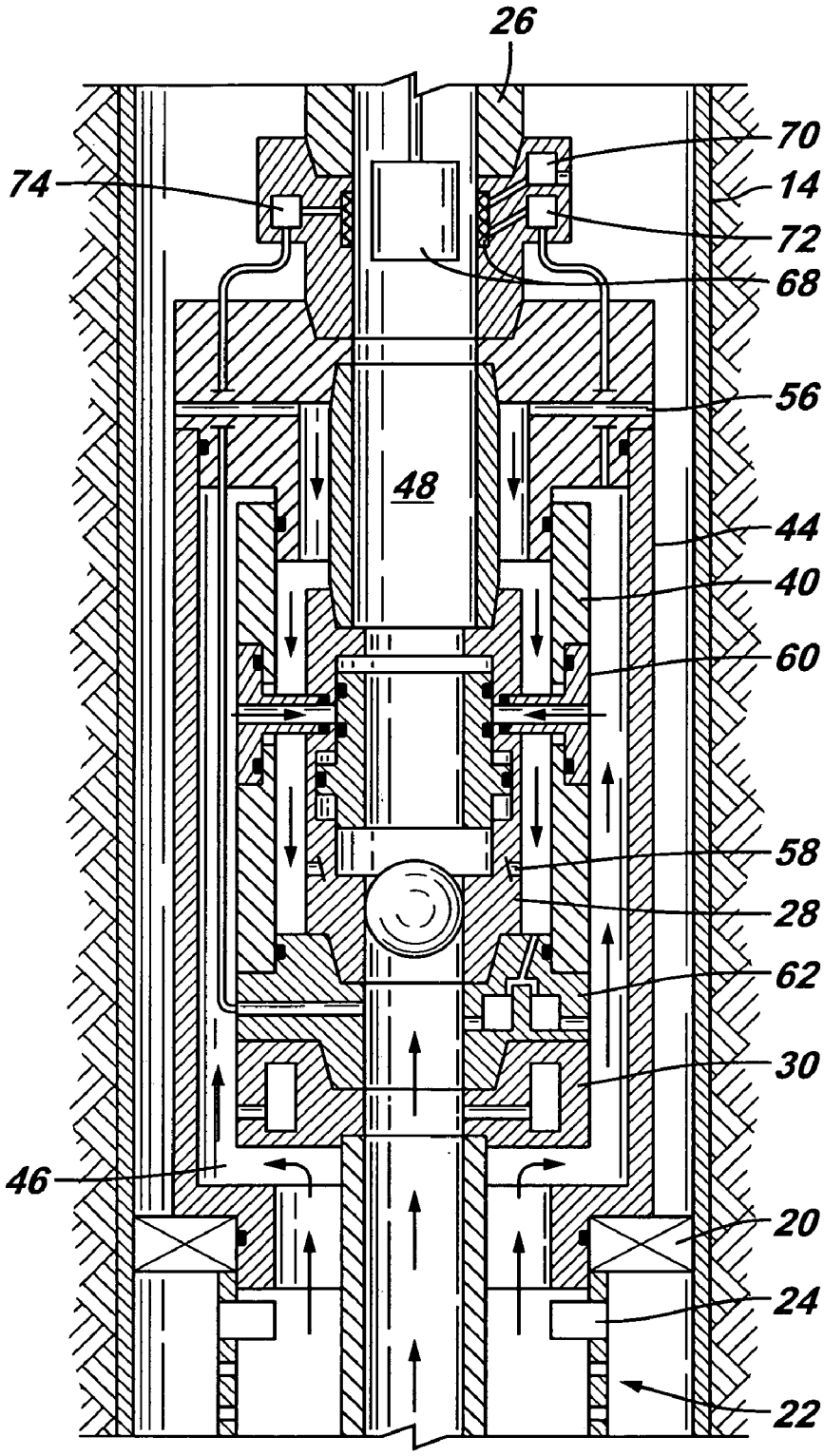
FIG. 3 is a schematic drawing of another embodiment of the multiple testing system of the present invention incorporating real time pressure and temperature measurement.

FIG. 3 is a schematic representation of another embodiment of multiple testing system 10 of the present invention incorporating real time pressure and temperature measurement. The embodiment of FIG. 3 is similar to that described with reference to FIG. 1. Multiple zone testing system 10 further includes an inductive coupler 68, a casing pressure sensor 70, an upper zone sensor 72, and a lower zone sensor 74.

Inductive connector 68 is communicatively connected to the surface (not shown) by an electric line 76. Inductive connector 68 is run inside the tubing string bore 48 on an electric line 26 for establishing a downhole wet connect for providing real time real time readout of date from gauges 30. Casing pressure sensor 70 is positioned to record the casing annulus pressure and transmit real time data via inductive coupler 68 to the surface. Upper zone sensor 72 is in communication between inductive coupler 68 and upper zone 16. Lower zone sensor 74 is in communication between inductive coupler 68 and lower zone 18. In this manner multiple zone testing system 10 facilitates a single run into wellbore 12 to individually test multiple zones and to review real time wellbore and formation data in addition to obtaining zone data that will be retrieved upon removal of multiple zone tester 10 from wellbore 12.

Figure 4:
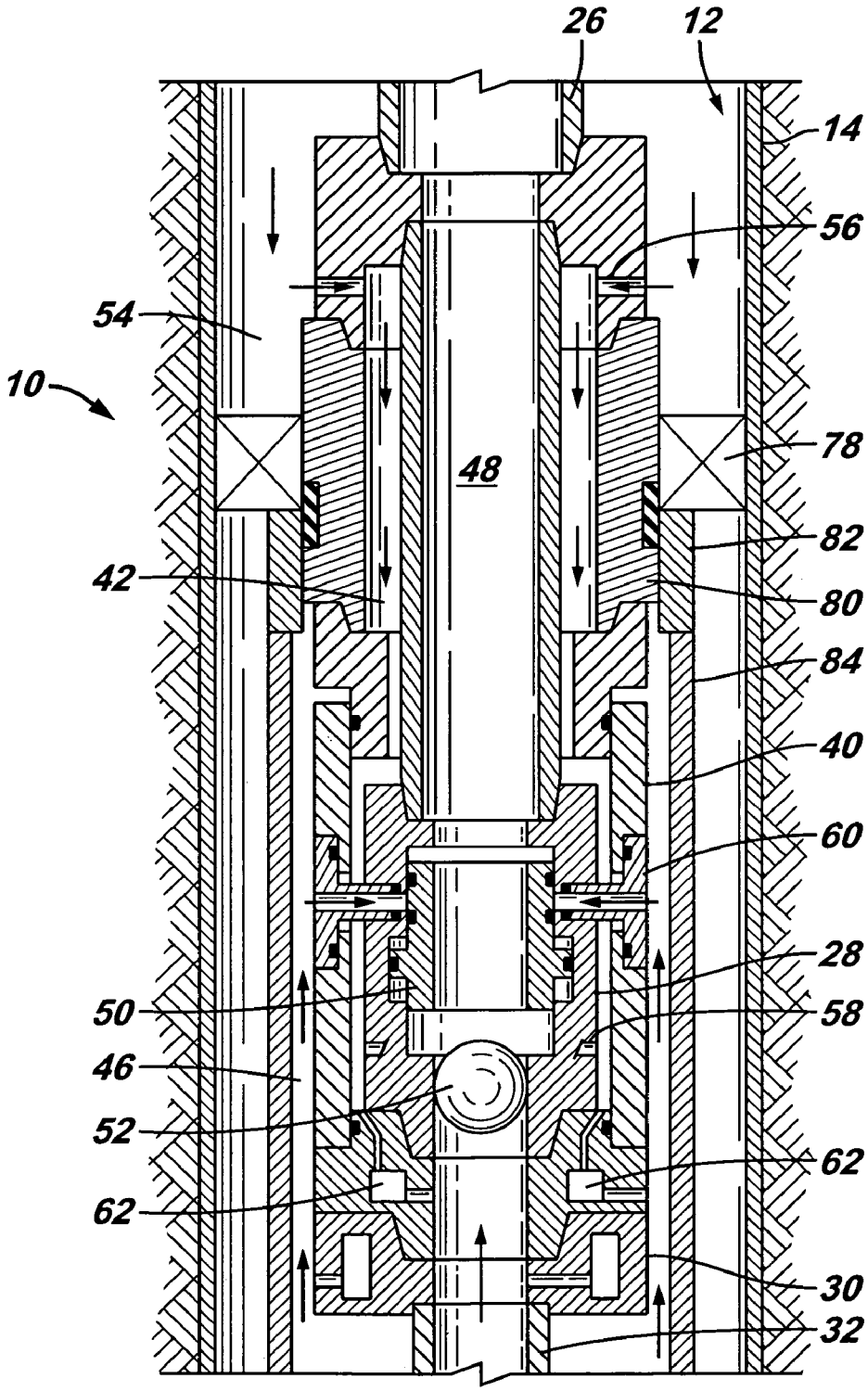
FIG. 4 is a schematic drawing of the multiple zone testing system of the present invention run below a packer.

FIG. 4 is a schematic representation of multiple zone testing system 10 of the present invention run below a packer 78. Packer 78 is set within wellbore 12 with multivalve mechanism 28 positioned between zones 16 and 18 and packer 78. Casing annulus port 56 is positioned above packer 78 to permit pulse signals to be communicated through fluid in casing annulus 54 to multivalve 28. Multiple zone tester 10 includes a seal assembly 80 positionable proximate the polished bore receptacle 82 of packer 78. An extension housing shroud 84 and multivalve assembly 28 form a fluid flow conduit 46 from upper zone 16 (FIGS. 1–3) between bore 48.

With referenced to FIGS. 1 through 4 a method of testing multiple producing zones of a well in a single trip is described. Wellbore 12 is drilled to a depth intersecting upper producing zone 16 and lower producing zone 18. The lower section of wellbore 12 including producing zones 16 and 18 is completed so as to include a lower and upper formation isolation valve 24 and at least a packer 20 having a polished bore receptacle 64 positioned between zones 16 and 18. The lower completion is now prepared for drillstem testing of zones 16 and 18. In the prior art testing systems a drillstem tester would be run in the hole to test lower zone 18, the well would then be killed and the DST would be removed. A second trip would then be made into the hole to test upper zone 16.

In the present inventive system, multiple zone tester 10 is run into wellbore 12 so that multiple zone tester 28 is landed in the lower completion. The polished bore receptacle 64 and the lower zone multiple zone assembly 34 have sufficient length so that the respective seal assemblies remain engaged inside PBR 64 during tubing hanger space out. Alternatively, the seal assembly 34 can be landed out on top of packer 20 and slip joints can run in the test string for tubing hanger space out. Both lower zone 18 and upper zone 16, and a commingled flow test may be conducted without removing multiple zone tester 10 from wellbore 12 and without killing the well between tests. As demonstrated in the Figures fluid flow from lower zone 18 is directed through bore 48 and controlled by lower valve 52. Fluid flow from upper zone 16 is directed exterior of bore 48 past gauges 30 and sample chamber 62 back to bore 48 via upper valve 50. For a commingled flow test both upper valve 50 and lower valve 52 may be actuated to the open position permitting flow from both zones into bore 48. As shown in FIG. 3 real time test data may be measured and conveyed to the surface for observation.

After the tests are completed and fluid is reversed out of drillstem sting 26, multiple zone tester 28 is picked up a sufficient distance to pull both shifting tools 36 and 38 through the lower formation isolation valve 24 closing it. Seal assemblies 34 remains in the polished bore receptacle 64 avoiding killing zones 16 and 18. Multiple zone tester 10 is then lowered a sufficient distance so that open only shifting tool 38 passes through lower formation isolation valve 24 opening it. Multiple tester is then pulled from wellbore 12, open/close shifter 36 passing through upper isolation valve 24 closing formation isolation valve 24 and isolating zones 16 and 18 from the upper portion of the well. The upper portion of wellbore 12 may then be completed above zones 16 and 18 without having to kill the zones.

From the foregoing detailed description of specific embodiments of the invention, it should be apparent that a single trip multiple zone tester that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow. For example, various materials of construction may be made, variations in the manner of completion of the zones of interest, types of valves, configuration and types of measuring gauges, and methods of sealing may be utilized. It should be clear that various methods and mechanisms for controlling the valves and relaying data to the surface may be utilized including various wireless telemetry devices including electromagnetic or acoustic signals.

What is claimed is:

1. A multiple zone tester for drillstem testing a well having multiple zones, the system comprising:

a multiple valve mechanism including an upper valve for controlling fluid flow from an upper zone via a flow conduit, and a lower valve for controlling fluid flow from a lower zone via a bore;

a control conduit formed between a well annulus and the multiple valve mechanism to communicate a signal to selectively actuate the upper and lower valves;

a seal assembly adapted for temporary sealing engagement with a lower completion;

an upper zone measurement gauge functionally connected to the flow conduit;

a lower zone measurement gauge functionally connected to the bore;

a sensor in connection with the fluid conduit adapted for obtaining data related to the upper zone;

a sensor in connection with the bore adapted for obtaining data related to the lower zone; and an inductive coupler in function connection with the sensors for transmitting the data.

2. The system of claim 1, wherein the upper valve is a sliding sleeve.

3. The system of claim 1, wherein the lower valve is a ball valve.

4. The system of claim 1, wherein the signal is a pressure pulse.

5. The system of claim 1, wherein the control conduit is a hydraulic line.

6. The system of claim 1, wherein the control conduit is an electric line.

7. The system of claim 1, wherein the upper zone measurement gauge is positioned between the upper valve and the upper zone.

8. The system of claim 1, wherein the lower zone measurement gauge is positioned between the lower valve and the lower zone.

9. The system of claim 1, further including a packer positioned between the lower completion and a port from the wellbore annulus to the control conduit.

10. The system of claim 1, further including:

an open/close shifting tool for engaging a formation isolation valve in the lower completion; and an open only shifting tool run below the open/close shifting tool for engaging a formation isolation valve in the lower completion.

11. The system of claim 1, further including:

a sample chamber in connection with the flow conduit; and a sample chamber in connection with the bore.

12. A multiple zone tester for drillstem testing a well having multiple zones, the system comprising:

a multiple valve mechanism including an upper valve for controlling fluid flow from an upper zone via a flow conduit, and a lower valve for controlling fluid flow from a lower zone via a bore;

a control conduit formed between a well annulus and the multiple valve mechanism to communicate a signal to selectively actuate the upper and lower valves;

an upper zone measurement gauge functionally connected to the flow conduit;

a lower zone measurement gauge functionally connected to the bore;

a dip tube extending below the multiple valve mechanism, the dip tube forming a portion of the bore;

a seal assembly carried by the dip tube, the seal assembly adapted for temporary sealing engagement with a lower completion;

an open/close shifting tool for engaging a formation isolation valve in the lower completion; and an open only shifting tool run below the open/close shifting tool for engaging a formation isolation valve in the lower completion;

wherein the bore is formed through a the multiple valve mechanism and the dip tube into a pipe string and the flow conduit extends from the upper zone to the bore via the upper valve positioned above the lower valve.

13. The system of claim 12, further including:

a sample chamber in connection with the flow conduit; and a sample chamber in connection with the bore.

14. The system of claim 12, further including:

a sensor in connection with the fluid conduit adapted for obtaining data related to the upper zone;

a sensor in connection with the bore adapted for obtaining data related to the lower zone; and an inductive coupler in function connection with the sensors for transmitting the data.

15. The system of claim 12, further including a packer positioned between the lower completion and a port from the wellbore annulus to the control conduit.

16. A method of drillstem testing multiple zones in a well comprising the steps of:

completing a lower zone and completing an upper zone to form a lower completion;

running a multiple zone tester into the well on a pipe string to the lower completion;

sealing the multiple zone tester in the lower completion in a manner such that fluid flow from the lower zone is controlled through a bore and fluid flow from the upper zone is controlled through a flow conduit;

actuating a lower valve in communication with the bore to an open position, and actuating an upper valve in communication with the flow conduit to a closed position to test the lower zone;

measuring characteristics of the lower zone;

actuating the lower valve in communication with the bore to a closed position, and actuating the upper valve in communication with the flow conduit to an open position to test the upper zone;

measuring characteristics of the upper zone;

circulating fluid out of the drillstring;

removing the multiple zone tester from the lower completion closing the top most formation isolation valve; and retrieving the measured zone characteristics obtained.

17. The method of claim 16, further including the step of:

actuating the lower valve in communication with the bore to an open position and actuating the upper valve in communication with the flow conduit to an open position to permit testing commingled fluid flow from the upper and lower zones.

18. The method of claim 16, further including the step of:

transmitting zone data received during testing of the lower and upper zone.

19. The method of claim 16, further including the steps of:

obtaining a sample of fluid from the upper zone; and obtaining a sample of fluid from the lower zone.

* * * * *